United States Patent [19]

Anderson et al.

[11] Patent Number: 4,764,997

[45] Date of Patent: Aug. 23, 1988

[54] SITZ BATH FOR USE WITH DOUCHE

[75] Inventors: Clifford M. Anderson, Yuba City; Brian D. Stearns, Roseville; Hillard T. Witt, Penn Valley, all of Calif.

[73] Assignee: Andermac, Yuba City, Calif.

[21] Appl. No.: 27,754

[22] Filed: Mar. 19, 1987

[51] Int. Cl.[4] ..... A47K 3/20

[52] U.S. Cl. ..... 4/420.3; 4/420.4; 4/445; 4/446

[58] Field of Search ..... 4/443–448, 4/420.1–420.5, 194, 195, 197, 198, 203, 204

[56] References Cited

U.S. PATENT DOCUMENTS

| | | | |
|---|---|---|---|
| 832,320 | 10/1906 | James | 4/198 |
| 2,947,994 | 8/1960 | Saulson et al. | 4/445 |
| 3,034,137 | 5/1962 | Glou | 4/445 |
| 3,039,117 | 6/1962 | Hoskins | 4/445 |
| 3,134,982 | 6/1964 | Pasquale | 4/447 |
| 3,729,748 | 5/1973 | Perlman | 4/445 |
| 4,205,402 | 6/1980 | Miller | 4/448 |
| 4,574,409 | 3/1986 | McAffrey | 4/579 |

FOREIGN PATENT DOCUMENTS

| | | | |
|---|---|---|---|
| 4019 | of 1891 | United Kingdom | 4/447 |

*Primary Examiner*—Henry J. Recla
*Assistant Examiner*—Linda J. Sholl
*Attorney, Agent, or Firm*—Townsend and Townsend

[57] ABSTRACT

A sitz bath appliance for use with a hand held bidet is disclosed which enables conventional cleaning with the hand held bidet followed by closing of a drain with medicated, sanitary, constant temperature soaking. The sitz bath includes a circular rim configured on the lower surface for support on the upper rim of a toilet bowl with the seat up and configured on the upper surface as a seat. The supported sitz bath bowl is provided with overflow ports to maintain a constant level of liquid for soaking. The front of the bowl is configured with an integral molded channel in a raised rim portion to permit a hand held bidet to be inserted between the spread thighs of a user and thereafter used under the seated patient.

1 Claim, 2 Drawing Sheets

SITZ BATH FOR USE WITH DOUCHE

BACKGROUND OF THE INVENTION

This invention relates to sitz baths and more particularly to a sitz bath configured for use with a hand held bidet.

SUMMARY OF THE PRIOR ART

Portable bidets for support on a toilette bowl with the seat raised are known. For example, Salvoni U.S. Pat. No. 2,036,985 discloses a portable bidet with a central mechanical drain. Romberger, Jr. U.S. Pat. No. 3,484,872 and Stolbach U.S. Pat. No. 3,490,079 disclose sitz baths mounted to toilet bowls. Restyanszki U.S. Pat. No. 3,654,636 discloses a bowl mounted bidet configured for contact with the thighs of the user.

Talge et al. U.S. Pat. No. 3,795,015 discloses a bidet including a central upsurge of water from a bottom mounted manifold.

STATEMENT OF THE PROBLEM

There is a need for a portable sitz bath combined with a hand held bidet. The need centers around required out patient hygiene. A bath which accommodates cleansing, soaking, and portability to complement outpatient post surgical care that can closely emulate the hospital environment is desirable.

The reader will understand that ofttimes recognition of a problem or need can constitute invention; insofar as recognition of that need constitutes a contribution to the art, invention is claimed.

SUMMARY OF THE INVENTION

A sitz bath appliance for use with a hand held bidet is disclosed which enables conventional cleaning with the hand held bidet followed by closing of a drain with medicated, sanitary, constant temperature soaking. The sitz bath includes a circular rim configured on the lower surface for support on the upper rim of a toilet bowl with the seat up and configured on the upper surface as a seat. The supported sitz bath bowl is provided with overflow ports to maintain a constant level of liquid for soaking. The front of the bowl is configured with an integral molded channel in a raised rim portion to permit a hand held bidet to be inserted between the spread thighs of a user and thereafter used under the seated patient. Mounted below the hand held bidet channel is a rectangular lower bath drain. Integral with and overlying the lower bath drain are U-channel side edges. A semi-rigid and flexible drain closure is mounted for movement along the U-channel side edges. This flexible closure moves towards and away from a drain closing position. The upper end of the semi-rigid drain closure defines an interval coincident to the interval of the hand held bidet channel. When the drain is raised, interference with the manipulated hand held bidet is prevented. When the drain is lowered, forward overflow ports are exposed over the top of the drain closure. In the preferred operation, the flexible drain closure is first used in the open position where the user manipulates the hand held bidet for conventional cleaning. Thereafter the drain is closed and the bath flooded with the hand held bidet, providing a constant temperature flow of medicated water which, when allowed to run, maintains a sanitary and constant temperature bath for soaking.

OTHER OBJECTS AND ADVANTAGES

An object of this invention is to disclose a sitz bath for use in combination with a hand held bidet. According to this aspect of the invention, the sitz bath is configured with a frontal channel for insertion of a hand held bidet. The channel is configured in a raised rim portion of the sitz bath. The channel defines an indentation within the raised portion of the rim. Thus the channel spreads the inside thighs of the front legs of the user and permits insertion and use of the hand held bidet.

An advantage of this aspect of the invention is that the patient can attend to hygiene in the privacy of the toilet either at home or in the hospital.

A further advantage is that the patient in utilizing a hand held bidet can manipulate the hand held bidet with the tactile senses. Cleansing can occur after sensitive surgery with more direction than can be provided even by professional nursing care.

A further advantage is that the hand held bidet manipulation in combination with the sitz bath is unmistakably easy to learn.

Yet another advantage of the toilet mounted sitz bath when filled from the hand held bidet is that transport of the full bath is not required for use. Therefore, semi-ambulatory patients are spared the inconvenience of transporting the bath with a large and unstable open surface.

An advantage of the disclosed rim of the sitz bath is that it is configured for gripping of the forward edge of the toilet bowl. This feature makes the bath easier to mount and provides a firm seat for the patient. Backward movement of the bowl with overall seat instability is avoided.

A further object of this invention is to disclose the configuration of a channel used in combination with the sitz bath. Specifically, the channel is given a cylindrical configuration down sloping at three degrees toward the bath bottom which will maintain the hand held bidet in position under the patient. This channel is provided at the forward portion with a constriction. This constriction permits the force fitting of the hand held bidet within the channel.

An advantage of the disclosed channel is that the hand held bidet may be adjusted in towards and away movement from under the patient. Consequently, individualized fitting of the hand held patient to the body and post surgical need of the patient is provided.

A further advantage of the disclosed channel constriction is that wedging of the hand held bidet into the channel can occur. Thus, hands free operation of the hand held bidet is permitted. Thus, the incapacitated or elderly can conveniently use the disclosed device by wedging the hand held bidet into the required and customary position.

A further object of this invention is to disclose a drain which can be manipulated with a sitz bath including a channel for the insertion of a hand held bidet. According to this aspect of the invention a rectangular drain slot is provided directly below the hand held bidet channel. The drain slot has parallel U-channel side edges. A semi-rigid drain closure is placed within the U-channel side edges and moves towards and away from a position of drain closure of the sitz bath. The upper end of the semi-rigid drain closure defines an indentation coincident with the hand held bidet channel. This defined indentation allows the drain to be opened without interference with manipulation of the hand held bidet. In the lowered position, the defined channel permits frontal drainage of the bath to occur through exposed frontal drainage ports.

An advantage of this aspect of the invention is that initial cleansing can occur with the drain open. This opening permits post-surgical blood and fecal material to be flushed, cleansed and ejected through the drain before soaking occurs.

A further advantage of this invention is that the drain can be closed with the hand held bidet in place to permit the inflow through the hand held bidet of medicated and constant temperature water. Soaking can occur.

Yet another advantage is that the bath can be provided with continually circulated constant temperature medicated water through the hand held bidet to maintain sanitary soaking conditions.

Yet another advantage of this invention is to provide for the stimulation of voiding, especially in the immediately post surgical situation. The mounting of the hand held bidet immediately over a toilet allows active cleansing of the patient during voiding with convenient disposal of urine and fecal material.

BRIEF DESCRIPTION OF THE DRAWINGS

Other objects, features, and advantages of this invention will become more apparent after referring to the following specification and attached drawings in which:

Referring to FIG. 1 the sitz bath S is shown mounted to a toilet bowl B, the toilet bowl being illustrated in broken lines.

Figure 1:
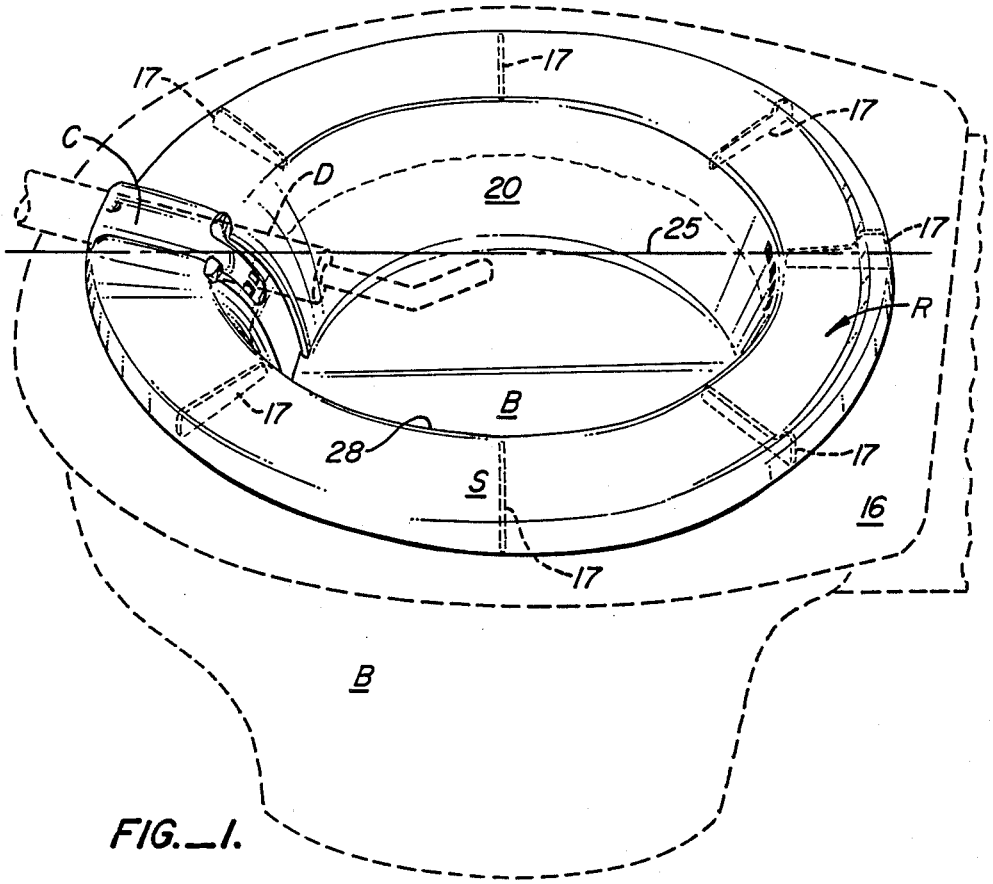
FIG. 1 is a perspective view of the sitz bath of this invention illustrating the bath inserted on and supported on the bowl of a toilet with a hand held bidet shown in the inserted position.
Figure 2:
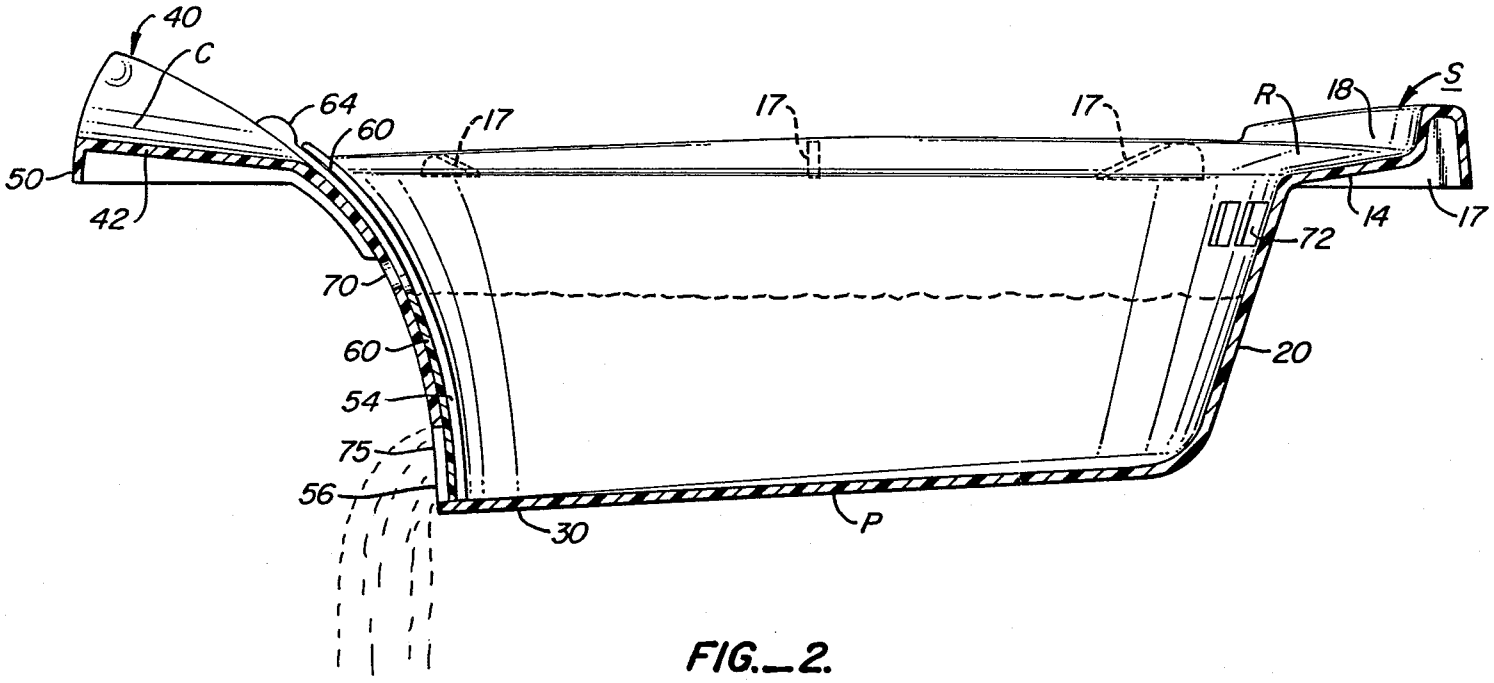
FIG. 2 is a side elevation of the bath of FIG. 1.

Referring to both FIG. 1 and FIG. 2, the sitz bath S can be understood. The bath includes a generally circular rim R which has two functions. On the lower surface 14 the rim R rests in a supported position on the upper surface 16 of toilet bowl B with the seat raised. This occurs around the entirety of the periphery of the bath. The underside of the rim is conventionally reinforced with integrally molded gussets 17. These gussets impart sufficient rigidity to the rim to enable support of the sitz bath on the bowl.

On the upper surface 18 the rim R defines a molded seat. This molded seat allows a user to sit in relative comfort upon the bath.

Depending downwardly from the integrally molded sitz bath S are bath sidewalls 20. The bath is generally elliptical about a major axis 25, the axis 25 being the plane of the section of FIG. 2.

Commencing from the profile of the ellipse at 28, the bath sidewalls 20 taper downwardly having a frustum shape. The broad end of the frustum is adjacent rim R. The narrow or apex end of the frustum is adjacent bottom B. Bottom B truncates the frustum. That is to say it is mounted at the lower end of walls 20 and forms the bottom closure to the bath.

Bottom B is not level. Bottom B instead slopes to and towards the front portion of the bath at lower portion 30.

Figure 3:
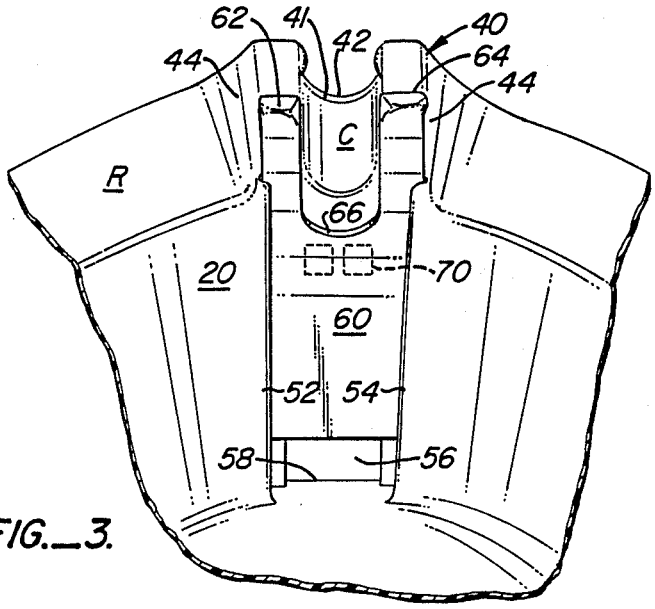
FIG. 3 is a view along lines 3—3 of FIG. 1 illustrating the drain and its conformance around the inserted hand held bidet.

Referring to FIG. 3 which is a perspective portion of the front of the bath, the combination hand held bidet channel and drain can be fully understood. Referring to FIGS. 1–3, a hand held bidet channel C is illustrated. Channel C extends from a raised forward portion of the rim R and slopes downwardly and into the bath along a channel bottom 42. Channel C at channel bottom 42 traverses rim R.

The channel C slopes downwardly under the patient at an approximate and preferred angle of three degrees. This permits individualized adjustment of the hand held bidet for both the anatomy of the patient as well as the immediate post surgical requirements.

Channel C is dimensioned to hold the bidet without being itself held by the patient. Thus, the patient can have both hands free for other bodily requirements. For example the aged and infirm can place the hand held bidet to the bath while sitting down on or getting up from the disclosed sitz bath.

Channel C has a constriction 41 at the forward portion of the bowl. This constriction 41 enables force fitting of the hand held bidet D into the channel C. This force fitting in effect wedges the hand held bidet into a custom fitted position of individual adjustment with respect to the patient. It is preferred that the bath end of the channel C be widened with respect to the remainder of the channel. This enables the hand held bidet to be maintained at many selected positions with respect channel to further the flexibility of the bath.

Since the rim R is raised in the vicinity of the channel, the channel includes two raised side edges 44. Edges 44 serve to spread the flesh of the inside thighs of the legs of the user. Thus, the forward channel C defines both with respect to the rim R of the bath and with respect to the inside thighs of the patient a channel for the insertion of the hand held bidet.

It will be seen that the forward and under edge of the sitz bath includes a downwardly protruding lip 50. Lip 50 is configured to grip the top of the forward portion of the toilet bowl to which the bidet is mounted. This lip in cooperation with the bowl provides several functions that are not immediately apparent.

First and foremost, the lip prevents the backward movement of the bath on the toilet. The patient is thus provided with a reliable and secure seat on the bowl.

Secondly, the lip in basing the grip of the seat on the forward portion of the bowl enables the bath to be used with a wide variety of toilets. Since toilets are not uniform, this feature enables the disclosed sitz bath to fit a wide variety of toilets.

Referring to the view of FIG. C, there is shown a bottom drain opening 56. Drain opening 56 is rectangular and extends across the forward portion of the walls 20 immediately below channel C at the lowest point of bottom B. Immediately below channel C, the bowl includes two U-channel side edges 52, 54. These side edges are for confining a semi-rigid drain piece 60.

Semi-rigid drain piece 60 is rectangular and extends downwardly of the U-sectioned edges 52, 54. Drain piece 60 in the upward position permits drainage. Drain piece 60 in the lowered position stops drain 58. Drain piece 60 is provided with two upper handles 62, 64. These respective handles form convenient places for user manipulation of the drain piece 60.

In between the respective handles 62, 64, there is defined an indentation 66. Indentation 66 is coextensive with hand held bidet channel C and has two separate functions.

First, and when drain piece 60 is in the upper position, U-channel 66 enables the raised drain piece 60 to be in a position of non-interference with the hand held bidet channel C.

Secondly, and when drain piece 60 is lowered, U-channel 66 clears two frontal drain ports 70. Thus, drain ports 70 in cooperation with ports 72 assure that the flooded sitz bath does not reach an excessive level to cause overflow.

Drain 56 includes a small lip 58 at the forward portion thereof. It is the function of lip 58 to form a positive liquid stop in cooperation with drain piece 60.

Typically, the outside of drain closure 60 is provided with a detent at 75. The detent at 75 prevents complete removal of the closure 60 by catching at the top edge of drain open 56.

Having set forth the construction of the sitz bath, operation can now be described.

Initial use of the sitz bath will occur with the sitz bath S being positioned on the rim 16 of a toilet bowl B with seat raised. Typically, drain 60 will be in the raised position.

A patient will sit on the bath. Raised edges 44 on either side of hand held bidet channel C will accomplish two purposes. First raised edges 44 will form an unobstructed interval for the insertion of a hand held bidet D such as that shown in broken lines on FIG. 1. Secondly, raised edges 44 will serve to spread the inside thighs of the user to assure unobstructed access. Typically, the hand held bidet will be manipulated and operated to effect a medicated and sanitary washing of the privates of the patient.

Thereafter, and once cleanliness has been achieved, drain piece 60 will be lowered. This will stop the bath. Thereafter, and using hand held bidet D, the bath will be flooded.

The type of hand held bidet utilized with this invention includes that described and claimed in McLaughlin U.S. Pat. Nos. 3,399,676 and 4,130,118. Typically, such appliances are provided for the dispensing of medicated constant temperature water from nearby taps (not shown). As has been previously emphasized, the hand held bidet and channel C are cooperatively sized. Specifically the dimension of the hand held bidet is such that channel C maintains the bidet in position during use without assistance from the patient.

Utilizing the hand held bidet as a water outflow, the bath will be flooded. It will flood to the level of drain ports 70 and 72. Soaking of the patient as prescribed can occur. During such soaking, the hand held bidet D can be used for the introduction of further flowing, constant temperature, medicated water. Outflow will occur through the ports 70, 72. Thus a clean and sanitary and constantly circulating soaking can occur.

Upon completion of the bath, drain port 64 is raised and the bath emptied. The sitz bath S is removed and conveniently cleaned.

It will be apparent that the disclosed bath enables outpatient treatment of high standard.

What is claimed is:

1. A sitz bath for mounting on a toilet bowl having a toilet bowl rim and for use with a hand held bidet nozzle placed across the sitz bath into the toilet bowl and under a user seated on the sitz bath comprising in combination:

a sitz bath having a water retaining bowl with a peripheral protruding rim;

said rim having a bottom surface for supporting said bath on the toilet bowl rim of said toilet bowl and having an upper surface for forming a seat for a patient seated upon said sitz bath;

at least one drain on the side walls of said water retaining bowl, said at least one drain being a predetermined distance below said rim whereby liquid retained within said bath is limited to the level of said drain;

a bidet channel defined across the front of said sitz bath rim at the forward portion of said sitz bath for receiving and permitting the manipulation of the hand held bidet nozzle, said channel being defined by a pair of raised protuberances extending upwardly from the plane of said upper surface defining said seat, said channel having a bottom surface spanning across said sitz bath rim and sloping downwardly toward the bowl, said bottom surface lying substantially in the same plane as the upper surface defining said seat, whereby said channel spans across said rim between the water retaining bowl and the exterior of said rim through and between the legs of said user seated on said rim;

said upwardly raised protuberances of said bidet channel further having means defining thigh spreading outside edges for the spreading of the flesh of the thighs of a seated patient to allow for the insertion of a hand held bidet nozzle between the thighs of a patient;

where the hand held bidet nozzle can be held in the channel between the spread thighs of said patient and under said patient into the interior of said bath.

* * * * *